US005940989A

United States Patent [19]

Liou

[11] Patent Number: 5,940,989

[45] Date of Patent: Aug. 24, 1999

[54] AIR VENTILATION OUTSOLE

[76] Inventor: Tian-An Liou, 58, Ma Yuan West St., Taichung, Taiwan

[21] Appl. No.: 09/050,411

[22] Filed: Mar. 30, 1998

[51] Int. Cl.[6] ..... A43B 7/06

[52] U.S. Cl. ..... 36/3 B; 36/29

[58] Field of Search ..... 36/3 B, 3 R, 29, 36/28, 35 B, 35 R

[56] References Cited

U.S. PATENT DOCUMENTS

| | | |
|---|---|---|
| 4,308,671 | 1/1982 | Bretschneider . |
| 4,587,749 | 5/1986 | Berlese . |
| 4,815,221 | 3/1989 | Diaz . |
| 4,835,883 | 6/1989 | Tetrault et al. . |
| 4,860,463 | 8/1989 | Pin . |
| 5,092,060 | 3/1992 | Frachey et al. . |
| 5,138,775 | 8/1992 | Chu . |
| 5,477,626 | 12/1995 | Kwon . |

*Primary Examiner*—Ted Kavanaugh

[57] ABSTRACT

An air ventilation outsole has a heel, a blind hole in the heel, a rear vent hole on the heel, and a ventilation pad disposed in the blind hole. The ventilation pad has a plurality of upper recesses, a plurality of lower recesses, a first breather hole, a second breather hole, a large number of reinforced ribs disposed in the ventilation pad defining a plurality of air chambers, a first rear aperture, a second rear aperture, a pair of first opposite lateral apertures, and a pair of second opposite lateral apertures. A U-shaped plug device has a first plug and a second plug. The first plug has a first main body, a first center hole, and a first annular flange. The second plug has a second main body, a second center hole, and a second annular flange. The first annular flange is inserted in the second rear aperture. The second annular flange is inserted in the first rear aperture.

6 Claims, 8 Drawing Sheets

AIR VENTILATION OUTSOLE

BACKGROUND OF THE INVENTION

The present invention relates to an outsole. More particularly, the present invention relates to an air ventilation outsole which can facilitate an air ventilation in a shoe.

A conventional outsole of a shoe does not have any air ventilation function at all. Therefore, the sweat of the user will remain in the shoe. Thus the sweat may cause uncomfortable odor.

SUMMARY OF THE INVENTION

An object of the present invention is to provide an air ventilation outsole which can facilitate an air ventilation in a shoe.

In accordance with a preferred embodiment, an air ventilation outsole comprises a heel, a blind hole formed in the heel, a vent hole formed on the heel and communicating with the blind hole, and a ventilation pad disposed in the blind hole. The ventilation pad is made of plastic materials. The ventilation pad comprises a plurality of upper recesses, a plurality of lower recesses, a first breather hole formed on an upper portion of the ventilation pad, a second breather hole formed on the upper portion of the ventilation pad, a large number of reinforced ribs disposed in the ventilation pad defining a plurality of air chambers, a first rear aperture, a second rear aperture, a pair of first opposite lateral apertures, and a pair of second opposite lateral apertures. The first rear aperture and the second rear aperture communicate with the respective air chamber. The first opposite lateral apertures communicate with the respective air chamber. The second opposite lateral apertures communicate with the respective air chamber. A U-shaped plug device has a first plug and a second plug. The U-shaped plug device is made of plastic materials. The first plug has a first main body, a first center hole, and a first annular flange. The second plug has a second main body, a second center hole, and a second annular flange. The first annular flange is inserted in the second rear aperture. The second annular flange is inserted in the first rear aperture.

In accordance with another preferred embodiment, an air ventilation outsole comprises a heel, a blind hole formed in the heel, a first rear vent hole formed on the heel and communicating with the blind hole, a second rear vent hole formed on the heel and communicating with the blind hole, and a ventilation pad disposed in the blind hole. The ventilation pad is made of plastic materials. The ventilation pad comprises a plurality of upper recesses, a first breather hole, a second breather hole, and a plurality of lower posts. A U-shaped plug device has a first plug and a second plug. The U-shaped plug device is made of plastic materials. The first plug has a first main body, a first center hole, and a first annular flange. The second plug has a second main body, a second center hole, and a second annular flange. The first annular flange is inserted in the first rear vent hole. The second annular flange is inserted in the second rear vent hole.

DETAILED DESCRIPTION OF THE INVENTION

Figure 1:
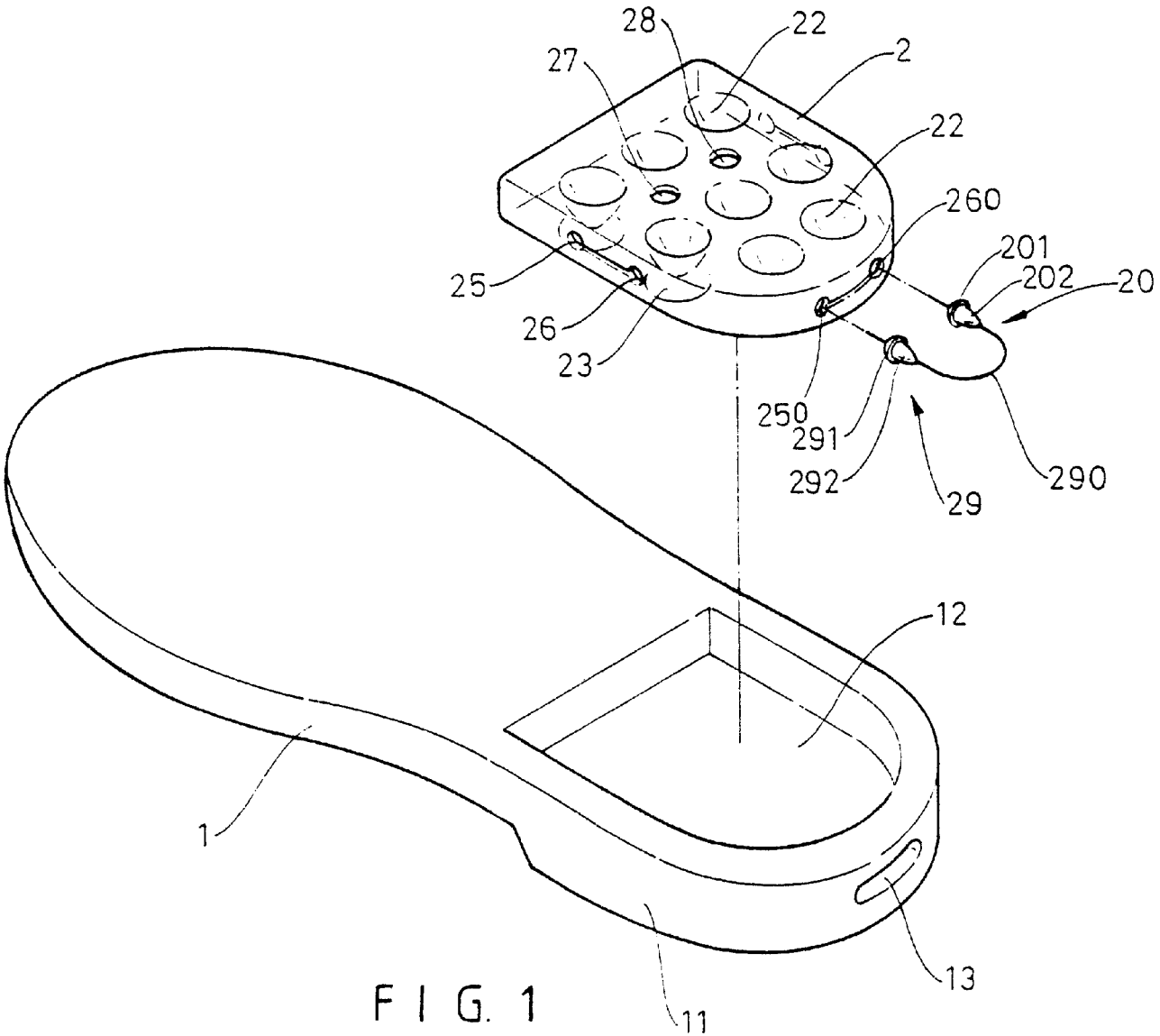
FIG. 1 is a perspective exploded view of an air ventilation outsole of a first preferred embodiment in accordance with the present invention.
Figure 2:
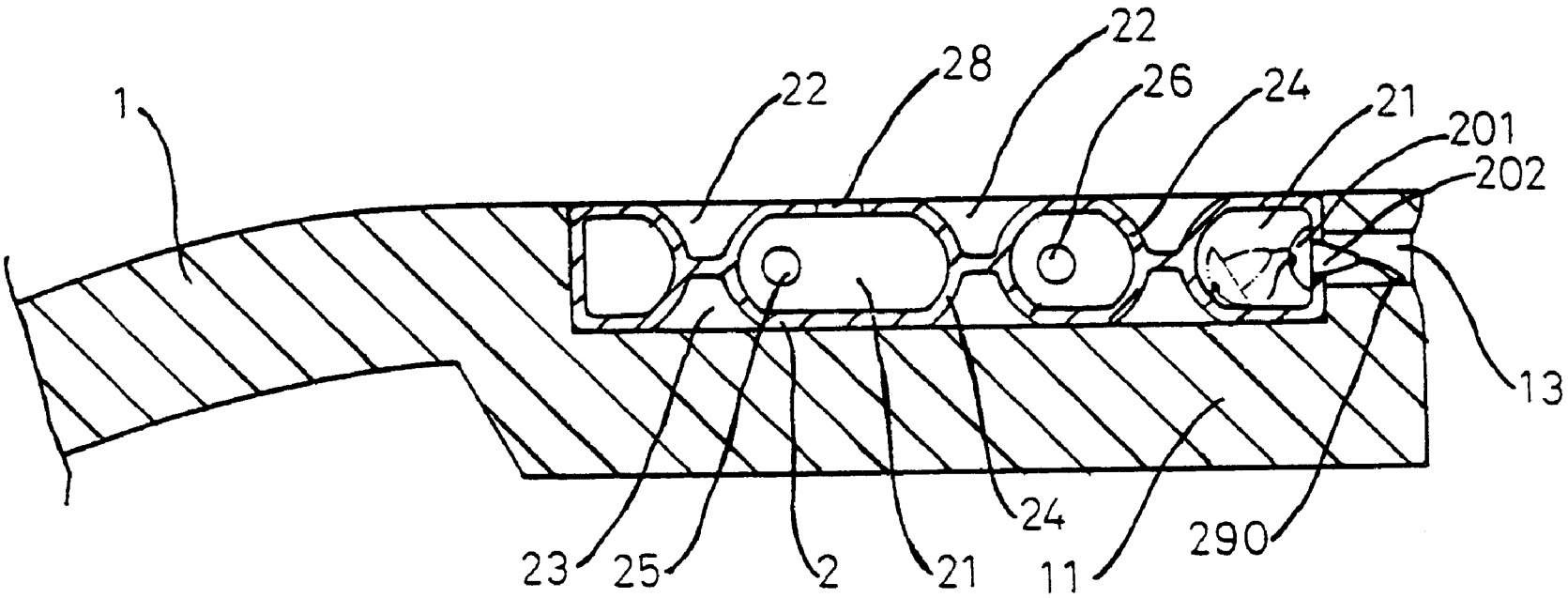
FIG. 2 is a sectional assembly view of an air ventilation outsole of a first preferred embodiment in accordance with the present invention.
Figure 3:
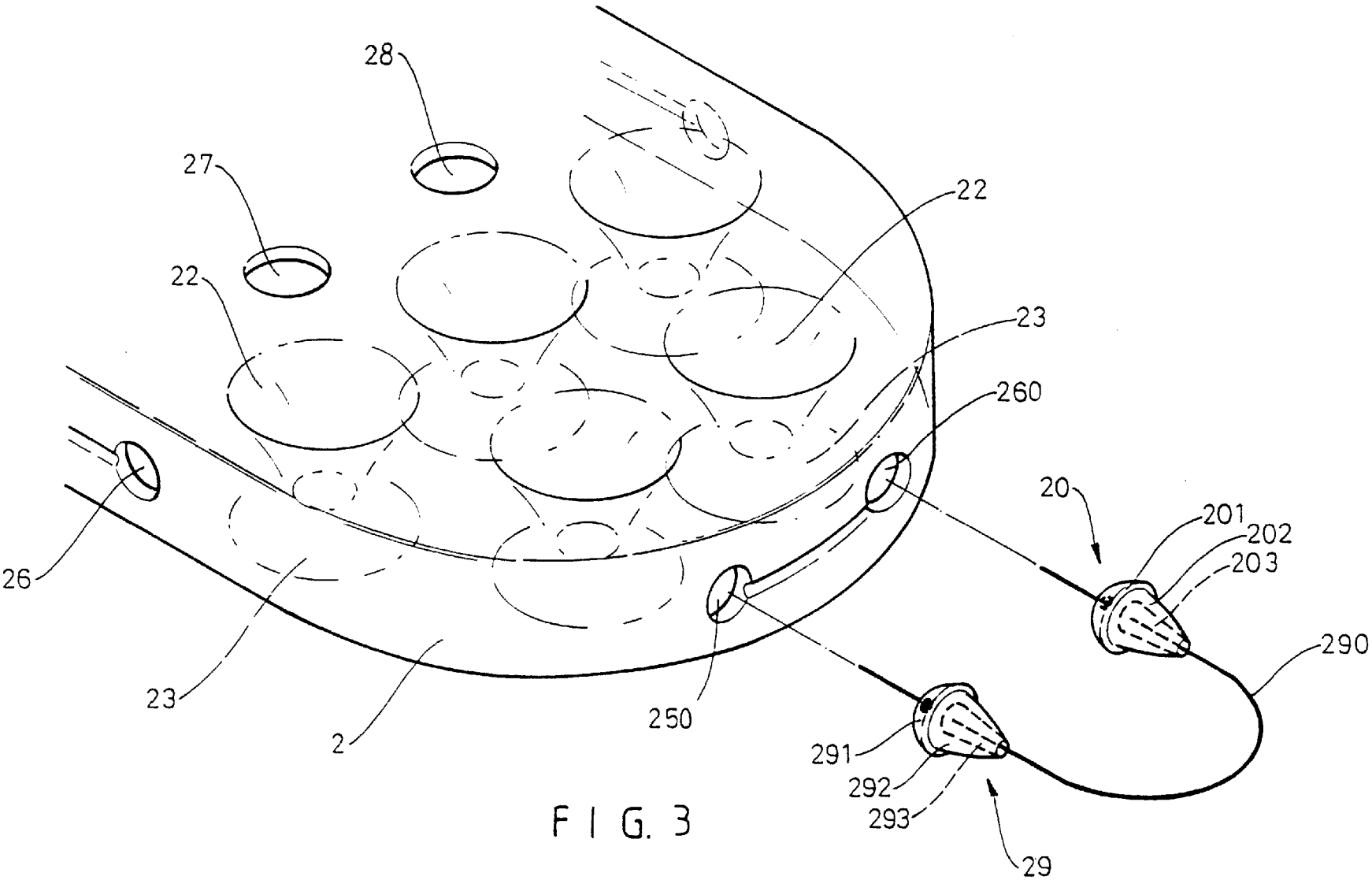
FIG. 3 is a partially enlarged perspective view of a ventilation pad of a first preferred embodiment in accordance with the present invention.

Referring to FIGS. 1 to 3, a first air ventilation outsole 1 comprises a heel 11, a blind hole 12 formed in the heel 11, a rear vent hole 13 formed on the heel 11 and communicating with the blind hole 12, and a ventilation pad 2 disposed in the blind hole 12. The ventilation pad 2 is made of plastic materials.

The ventilation pad 2 comprises a plurality of upper recesses 22, a plurality of lower recesses 23, a first breather hole 27 formed on an upper portion of the ventilation pad 2, a second breather hole 28 formed on the upper portion of the ventilation pad 2, a large number of reinforced ribs 24 disposed in the ventilation pad 2 defining a plurality of air chambers 21, a first rear aperture 250, a second rear aperture 260, a pair of first opposite lateral apertures 25, and a pair of second opposite lateral apertures 26. The first rear aperture 250 and the second rear aperture 260 communicate with the respective air chamber 21. The first opposite lateral apertures 25 communicate with the respective air chamber 21. The second opposite lateral apertures 26 communicate with the respective air chamber 21.

A U-shaped plug device 290 has a first plug 20 and a second plug 29. The U-shaped plug device 290 is made of plastic materials. The first plug 20 has a first main body 202, a first center hole 203, and a first annular flange 201. The second plug 29 has a second main body 292, a second center hole 293, and a second annular flange 291. The first annular flange 201 is inserted in the second rear aperture 260. The second annular flange 291 is inserted in the first rear aperture 250.

Figure 4:
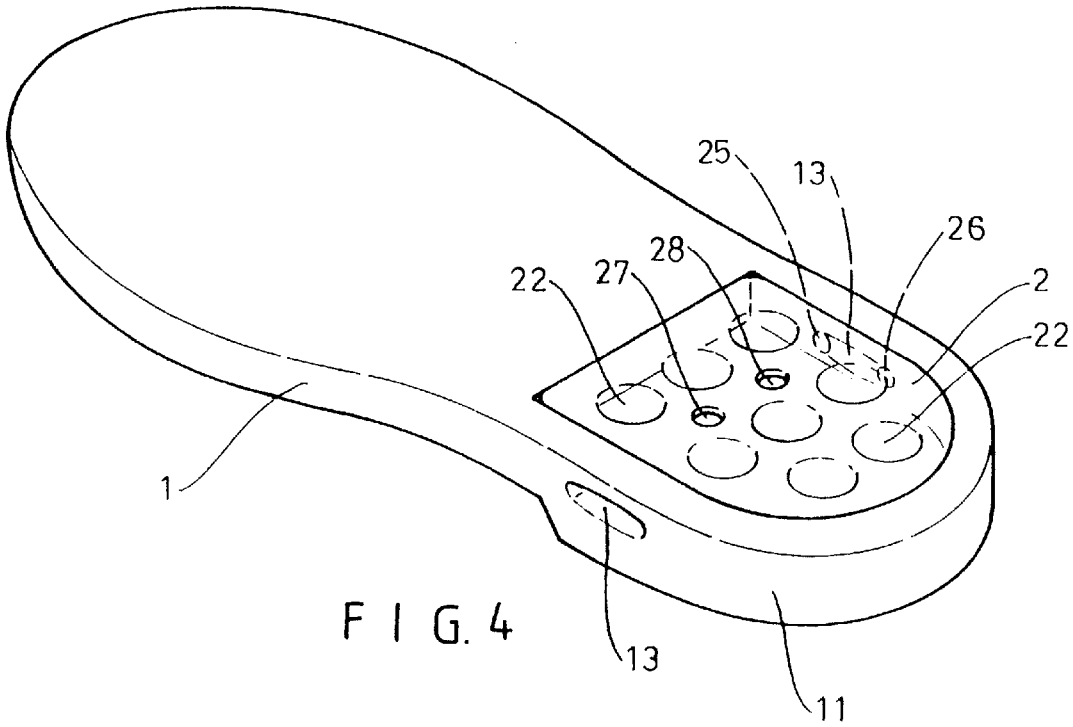
FIG. 4 is a perspective assembly view of an air ventilation outsole of a second preferred embodiment in accordance with the present invention.

Referring to FIG. 4, a pair of lateral vent holes 13 are formed on the heel 11 communicating with the blind hole 12 (in order to replace the rear vent hole 13 in FIG. 1).

Figure 5:
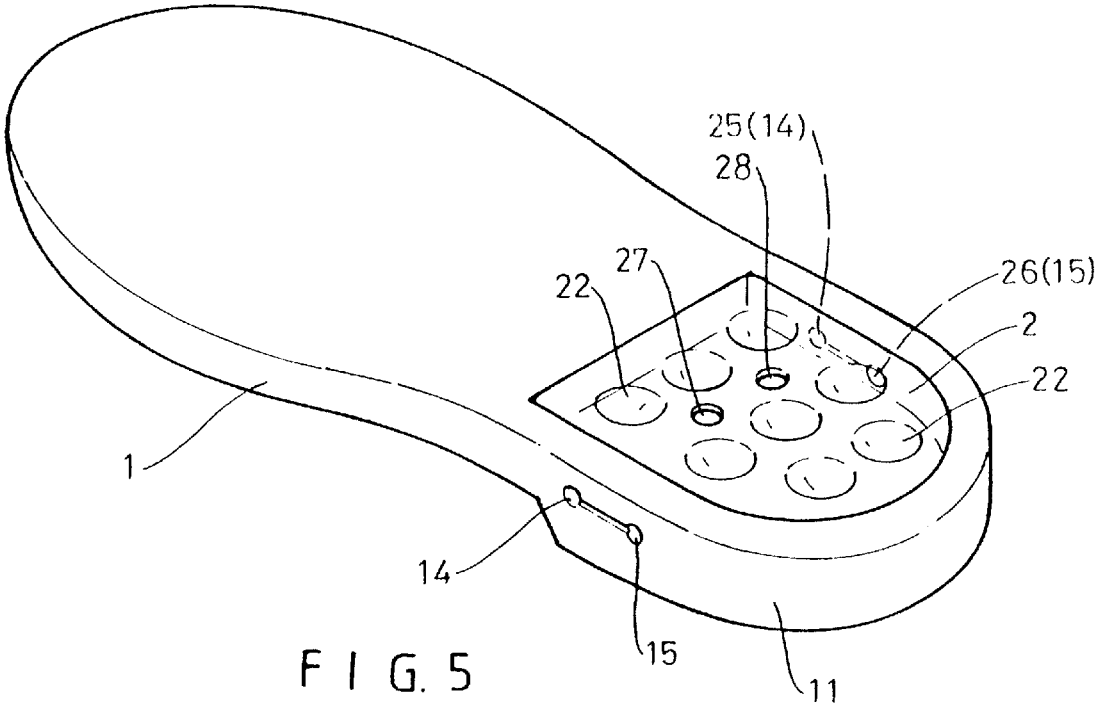
FIG. 5 is a perspective assembly view of an air ventilation outsole of a third preferred embodiment in accordance with the present invention.

Referring to FIG. 5, a pair of first lateral vent holes 14 and a pair of second vent holes 15 are formed on the heel 11 communicating with the blind hole 12 (in order to replace the rear vent hole 13 in FIG. 1).

Figure 6:
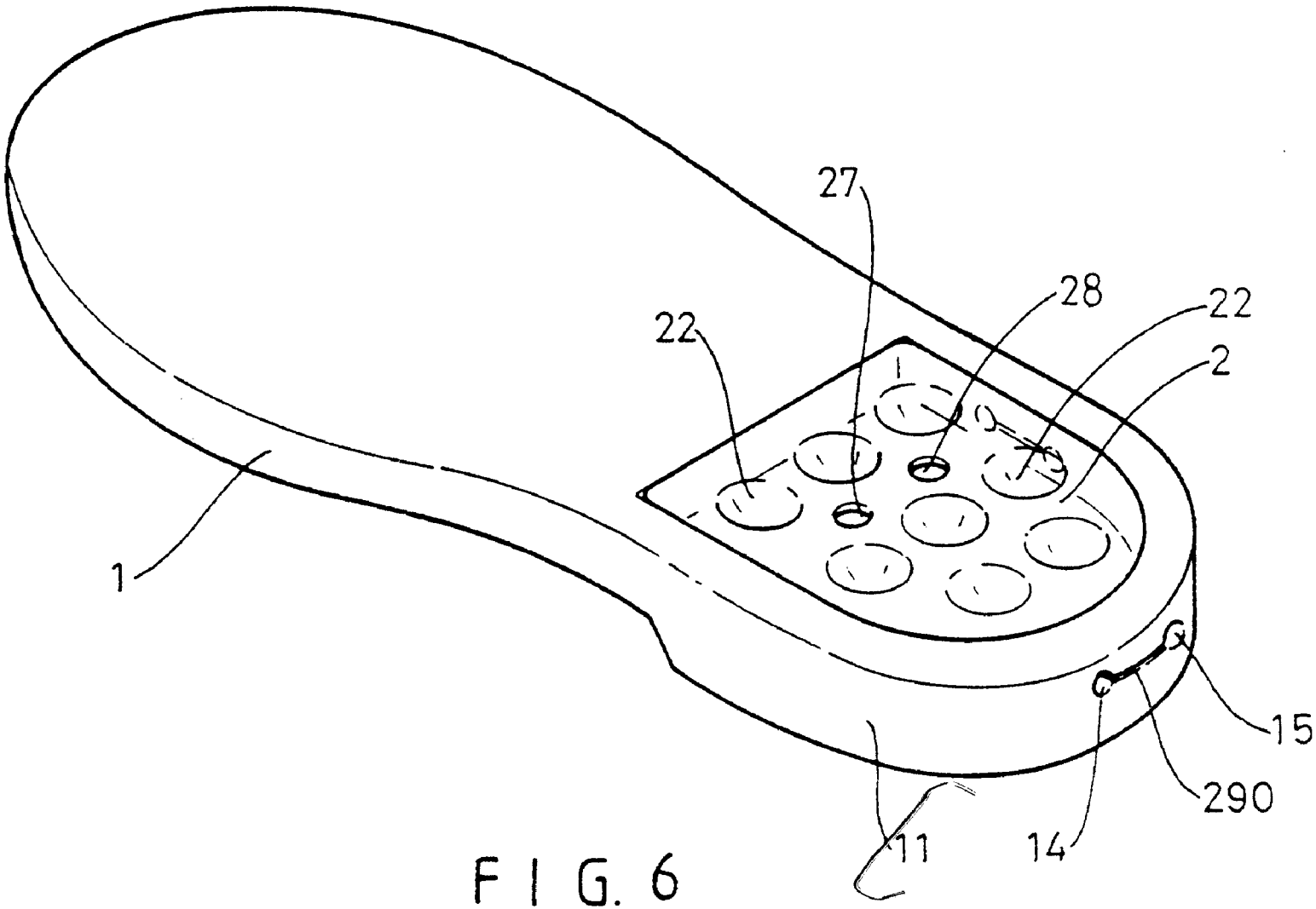
FIG. 6 is a perspective assembly view of an air ventilation outsole of a fourth preferred embodiment in accordance with the present invention.

Referring to FIG. 6, a first rear vent hole 14 and a second rear vent hole 15 are formed on the heel 11 communicating with the blind hole 12 (in order to replace the rear vent hole 13 in FIG. 1). The U-shaped plug device 290 is inserted in the first rear vent hole 14 and the second rear vent hole 15.

Figure 7:
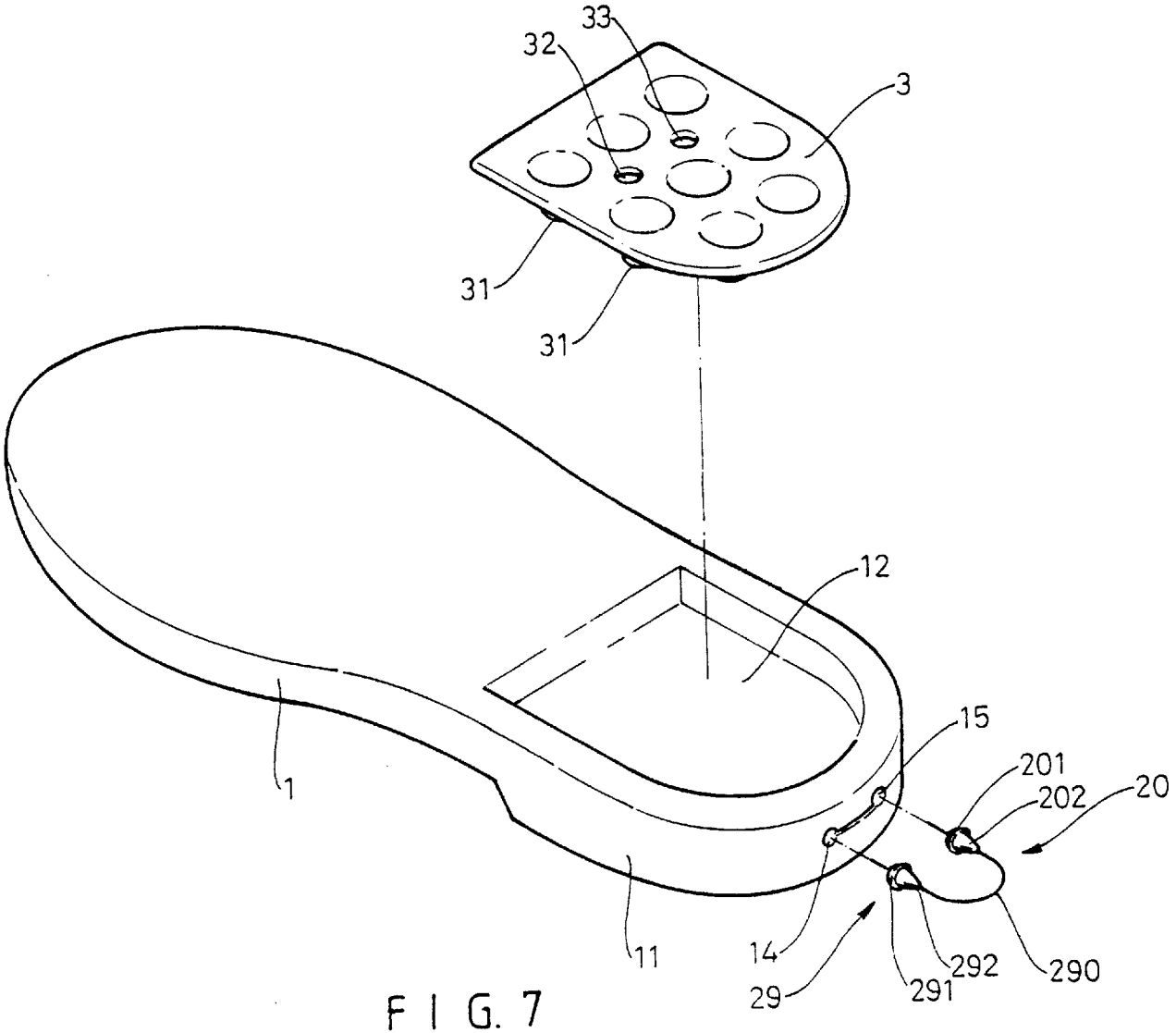
FIG. 7 is a perspective exploded view of an air ventilation outsole of a fifth preferred embodiment in accordance with the present invention.
Figure 9:
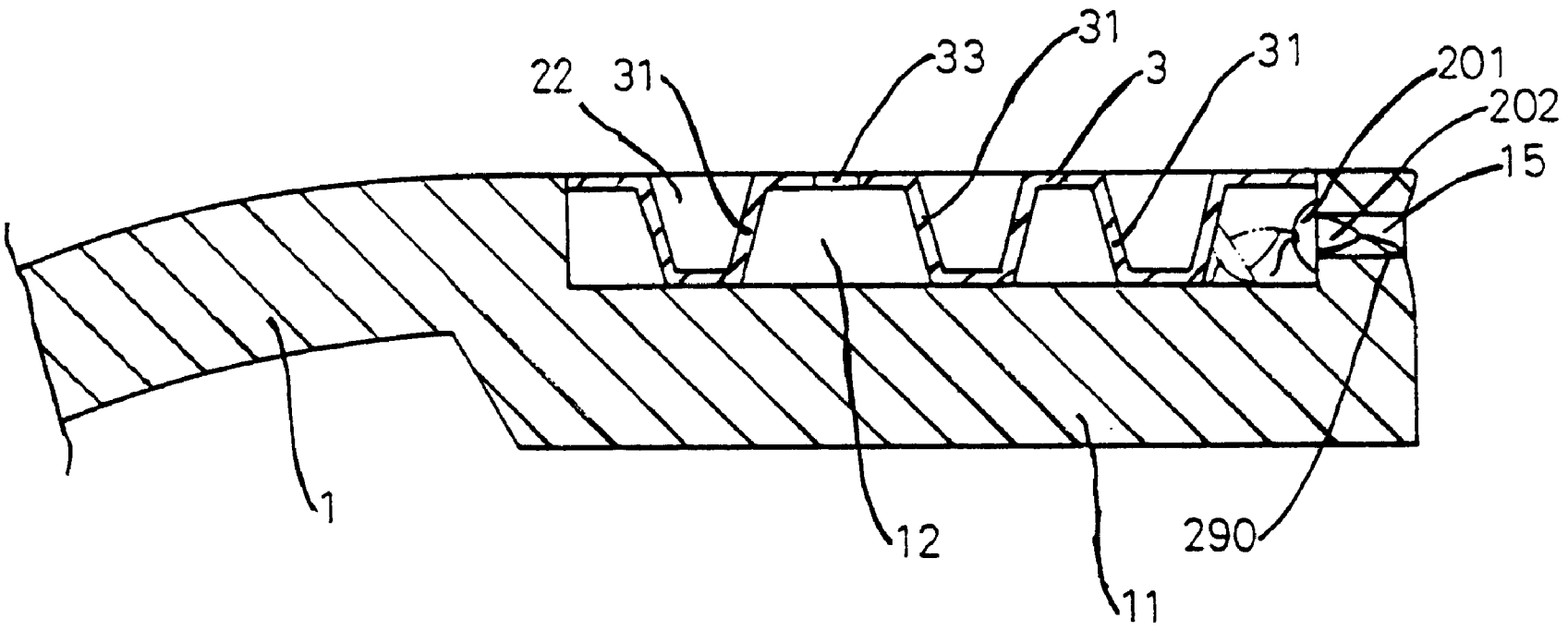
FIG. 9 is a perspective assembly view of the fifth preferred embodiment.

Referring to FIGS. 7 and 9, a fifth air ventilation outsole 1 comprises a heel 11, a blind hole 12 formed in the heel 11, a first rear vent hole 15 formed on the heel 11 and communicating with the blind hole 12, a second rear vent hole 14 formed on the heel 11 and communicating with the blind hole 12, and a ventilation pad 3 disposed in the blind hole 12. The ventilation pad 3 is made of plastic materials.

The ventilation pad 3 comprises a plurality of upper recesses 22, a first breather hole 32, a second breather hole 31, and a plurality of lower posts 31.

A U-shaped plug device 290 has a first plug 20 and a second plug 29. The U-shaped plug device 290 is made of plastic materials. The first plug 20 has a first main body 202, a first center hole 203, and a first annular flange 201. The second plug 29 has a second main body 292, a second center hole 293, and a second annular flange 291. The first annular flange 201 is inserted in the first rear vent hole 15. The second annular flange 291 is inserted in the second rear vent hole 14.

Figure 8:
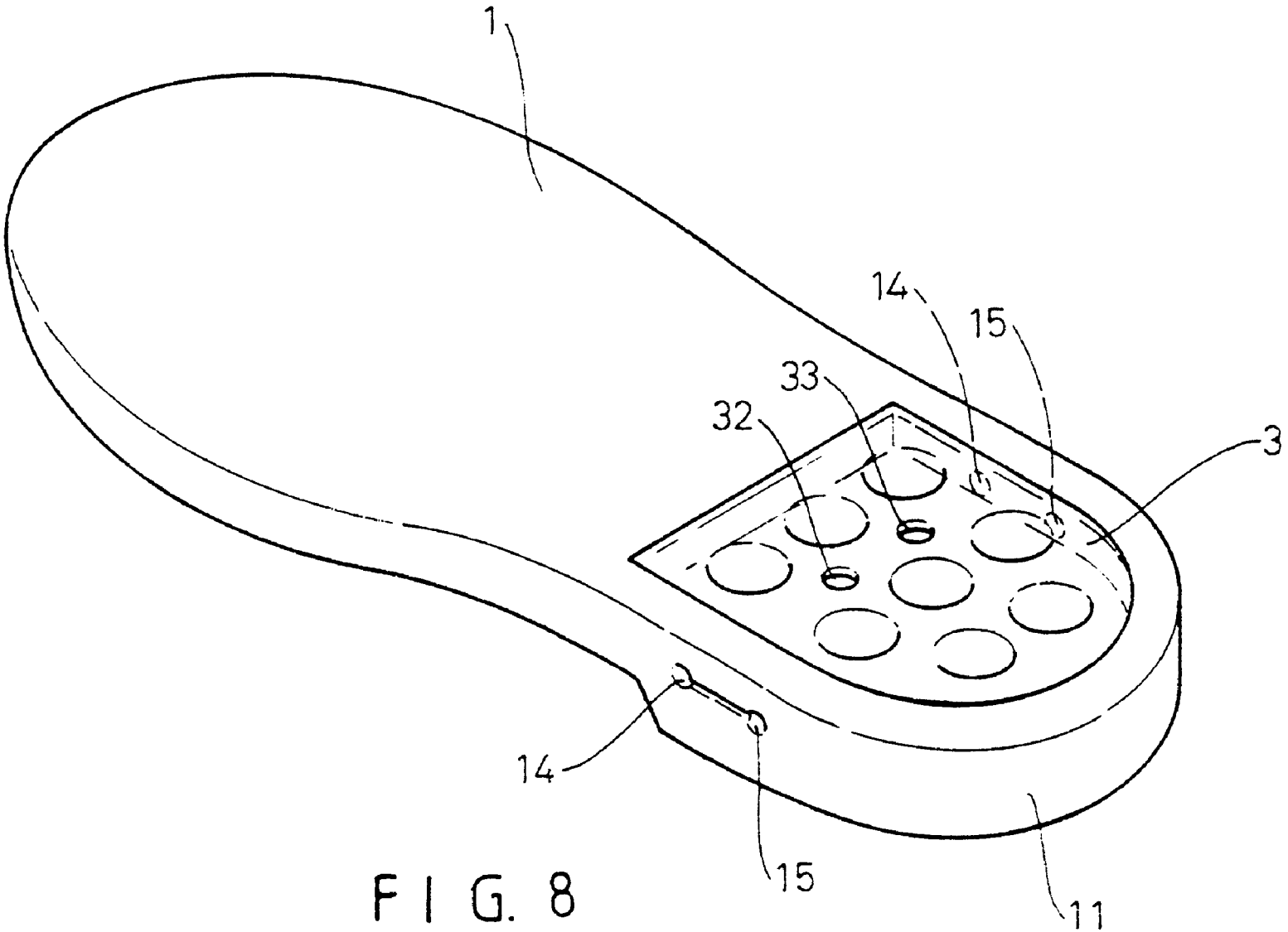
FIG. 8 is a perspective assembly view of an air ventilation outsole of a sixth preferred embodiment in accordance with the present invention.

Referring to FIG. 8, a first lateral vent hole 14 and a second vent hole 15 are formed on the heel 11 communicating with the blind hole 12 (in order to replace the first rear vent hole 15 and the second rear vent hole 14 in FIG. 7).

The invention is not limited to the above embodiment but various modification thereof may be made. Further, various changes in form and detail may be made without departing from the scope of the invention.

I claim:

1. An air ventilation outsole comprises:

a heel, a blind hole formed in the heel, a vent hole formed on the heel and communicating with the blind hole, and a ventilation pad disposed in the blind hole, the ventilation pad made of plastic materials, the ventilation pad comprising a plurality of upper recesses, a plurality of lower recesses, a first breather hole formed on an upper portion of the ventilation pad, a second breather hole formed on the upper portion of the ventilation pad, a large number of reinforced ribs disposed in the ventilation pad defining a plurality of air chambers, a first rear aperture, a second rear aperture, a pair of first opposite lateral apertures, and a pair of second opposite lateral apertures, the first rear aperture and the second rear aperture communicating with the respective air chamber, the first opposite lateral apertures communicating with the respective air chamber, the second opposite lateral apertures communicating with the respective air chamber, a U-shaped plug device having a first plug and a second plug, the U-shaped plug device made of plastic materials, the first plug having a first main body, a first center hole, and a first annular flange, the second plug having a second main body, a second center hole, and a second annular flange, the first annular flange inserted in the second rear aperture, and the second annular flange inserted in the first rear aperture.

2. An air ventilation outsole as claimed in claim 1, wherein the vent hole is formed on a rear portion of the heel.

3. An air ventilation outsole as claimed in claim 1, wherein the vent hole is formed on a lateral of the heel.

4. An air ventilation outsole comprises:

a heel, a blind hole formed in the heel, a first vent hole formed on the heel and communicating with the blind hole, a second rear vent hole formed on the heel and communicating with the blind hole, and a ventilation pad disposed in the blind hole, the ventilation pad made of plastic materials, the ventilation pad comprising a plurality of upper recesses, a first breather hole, a second breather hole, and a plurality of lower posts, a U-shaped plug device having a first plug and a second plug, the U-shaped plug device made of plastic materials, the first plug having a first main body, a first center hole, and a first annular flange, the second plug having a second main body, a second center hole, and a second annular flange, the first annular flange inserted in the first rear vent hole, and the second annular flange inserted in the second rear vent hole.

5. An air ventilation outsole as claimed in claim 4, wherein the vent hole is formed on a rear portion of the heel.

6. An air ventilation outsole as claimed in claim 4, wherein the vent hole is formed on a lateral of the heel.

* * * * *